US008123209B2

(12) United States Patent
Kubota et al.

(10) Patent No.: US 8,123,209 B2
(45) Date of Patent: Feb. 28, 2012

(54) SHEET COLLECTING METHOD, SHEET CORRECTING APPARATUS, POST-PROCESSING APPARATUS, AND IMAGE FORMATION SYSTEM

(75) Inventors: Ichitaro Kubota, Minamikoma-gun (JP); Kazuhiko Watanabe, Nirasaki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 211 days.

(21) Appl. No.: 12/591,683

(22) Filed: Nov. 30, 2009

(65) Prior Publication Data

US 2010/0150636 A1 Jun. 17, 2010

(30) Foreign Application Priority Data

Dec. 11, 2008 (JP) ..... 2008-316132

(51) Int. Cl.
*B65H 37/00* (2006.01)
*B65H 39/00* (2006.01)

(52) U.S. Cl. ..... 270/58.07; 270/58.08; 270/58.12; 270/58.17; 270/58.27

(58) Field of Classification Search ..... 270/58.07, 270/58.08, 58.11, 58.12, 58.17, 58.27, 58.1; 271/225, 228
See application file for complete search history.

(56) References Cited

U.S. PATENT DOCUMENTS

| | | | | |
|---|---|---|---|---|
| 6,427,997 | B1 * | 8/2002 | Hirota et al. | 270/58.12 |
| 7,165,764 | B2 * | 1/2007 | Nakamura et al. | 270/58.11 |
| 7,192,020 | B2 * | 3/2007 | Hayashi et al. | 270/58.11 |
| 7,731,169 | B2 * | 6/2010 | Saito | 270/58.12 |
| 2006/0208411 | A1 * | 9/2006 | Saito et al. | 270/58.07 |
| 2010/0007070 | A1 * | 1/2010 | Iguchi et al. | 270/18 |

FOREIGN PATENT DOCUMENTS

JP 2006-248686 9/2006

* cited by examiner

*Primary Examiner* — Leslie A Nicholson, III
(74) *Attorney, Agent, or Firm* — Manabu Kanesaka

(57) ABSTRACT

A sheet collecting apparatus has a sheet discharge outlet, a tray device for bearing and storing sheets, a regulation stopper disposed in the tray device; a forward/backward rotation roller, a roller lifting/lowering device, a sheet pressing guide disposed between the forward/backward rotation roller and the regulation stopper; a pressing force reducing device for reducing a pressing force, and a control device for controlling the forward/backward rotation roller, the roller lifting/lowering device and the pressing force reducing device. The control device is configured to rotate forward the forward/backward rotation roller in the operating position to move forward a carried-in sheet in the sheet discharge direction by a predetermined distance, and then rotate backward the forward/backward rotation roller. The control device has two operation modes that are selectively executed a first operation mode and a second operation mode.

7 Claims, 9 Drawing Sheets

SHEET COLLECTING METHOD, SHEET CORRECTING APPARATUS, POST-PROCESSING APPARATUS, AND IMAGE FORMATION SYSTEM

BACKGROUND OF THE INVENTION

The present invention relates to a sheet collecting apparatus and collecting method of the apparatus for bearing and storing sheets carried out of a sheet discharge outlet in a post-processing apparatus, an image formation apparatus, etc. and more particularly, to improvements in an aligning mechanism and aligning method for neatly positioning and storing sheets fed onto tray means.

Generally, this type of sheet collecting apparatus has widely been known as an apparatus for bearing and storing sheets fed to a sheet discharge outlet of an image formation apparatus, etc. For example, post-processing apparatuses are known which have a post-processing unit for temporarily bearing sheets from the sheet discharge outlet to collate for each set, and performing post-processing such as binding processing, folding processing and punching processing on a bunch of sheets, and collect sheets with images formed for each set to perform bookbinding stapling, punching filing holes and the like.

As such a sheet collecting apparatus, conventionally, for example, Japanese Laid-Open Patent Publication No. 2006-248686 [Patent Document 1] discloses in FIG. 3 an apparatus where a processing tray is disposed on the downstream side of the sheet discharge outlet, and a sheet from the sheet discharge outlet is switched back to the tray and loaded and stored. Then, a collection structure is proposed where the post-processing means such as stapling binding is disposed in the rear end portion of the tray, and in switching the sheet back to store, the sheet is forced to strike a regulation stopper disposed in the tray rear end portion to be aligned.

When a sheet is loaded on the tray from the sheet discharge outlet as described, Patent Document 1 as described above discloses a method where a forward/backward rotation roller is disposed above the tray to be able to move up and down, the roller moves downward to transport a sheet in the sheet discharge direction after the sheet front end enters onto the tray, and next, in the stage where the sheet rear end enters onto the tray, the roller is rotated backward to switch the sheet back to transport.

When a sheet fed from the sheet discharge outlet is thus moved forward on the tray, and then, moved backward to strike the stopper to be aligned, the uppermost sheet already stored on the tray sometimes interferes with alignment of the transported sheet. The interference phenomenon of the uppermost sheet will be described based on FIG. 9. In FIG. 9, in loading and storing a sheet from a sheet discharge outlet 90 on a tray 91, a forward/backward rotation roller 92 is disposed above the tray to be able to move up and down, the forward/backward rotation roller 92 moves down to an operating position to move the sheet forward in the sheet discharge direction in the stage where the sheet front end enters onto the tray from the sheet discharge outlet 90, and after the rear end of the sheet enters onto the tray 91, the forward/backward rotation roller 92 is rotated reversely to cause the sheet rear end to strike a rear-end regulation stopper 93 to align. In such a conventional structure, the uppermost sheet Su stored on the tray is fed together by the backward action of the transported sheet caused by backward rotation of the forward/backward rotation roller 92, and the sheet rear end is sometimes curved and becomes deformed as shown in FIG. 9.

Thus, when the uppermost sheet is curved, becomes deformed and raised, the front end of the transported sheet cannot enter between a sheet-surface pressing guide 94 disposed in front of the rear-end regulation stopper 93 and the uppermost sheet, and a sheet jam occurs, or the front end is folded when entering the sheet-surface pressing guide 94. The sheet-surface pressing guide 94 presses the sheet by an appropriate pressing force and prevents the curled sheet from rising, in causing the sheet end to strike the rear-end regulation stopper 93 to align. Therefore, the sheet-surface pressing guide 94 is required to meet conditions that the guide 94 allows the front end of the transported sheet to enter easily, and after the sheet enters, presses the sheet end edge by an appropriate pressing force. Then, as the conditions of the guide, it is preferable that the pressing force varies significantly with the load amount of sheets on the tray.

The inventor of the invention reached noting that in reversing forward and backward the transport direction of a sheet to load and store on the tray to push against the regulation stopper to align, the sheet fed onto the tray causes the already loaded uppermost sheet to be fed together, and that double feeding of the uppermost sheet affects alignment of sheets.

It is an object of the invention to provide a sheet collecting apparatus for enabling sheets to be loaded and stored in a neatly aligned state with respect to a regulation stopper disposed in a tray when loading and storing the sheets on the tray. Further, it is another object of the invention to provide a sheet collecting apparatus without a sheet jam occurring due to a sheet pressing guide when a sheet carried onto the tray strikes the regulation stopper to be aligned in a curl corrected attitude by the sheet pressing guide.

BRIEF SUMMARY OF THE INVENTION

To attain the above-mentioned objects, the present invention adopts the following configuration. Provided are a tray means for bearing and storing sheets from a sheet discharge outlet, a regulation stopper for regulating a sheet by the sheet carried in the tray means striking the stopper, a forward/backward rotation roller for feeding the sheet carried onto the tray means from the sheet discharge outlet against the regulation stopper to align, a roller lifting/lowering means for supporting the forward/backward rotation roller to be able to move up and down between an operating position in which the roller comes into contact with an uppermost sheet and a standby position in which the roller is withdrawn above the sheet with respect to the tray means, a sheet pressing guide disposed between the forward/backward rotation roller and the regulation stopper to press the uppermost sheet on the tray means, a pressing force reducing means for reducing a pressing force of the sheet pressing guide acting on the uppermost sheet, and a control means for controlling the forward/backward rotation roller, the roller lifting/lowering means and the pressing force reducing means.

The control means is configured to rotate forward the forward/backward rotation roller in the operating position to move forward a carried-in sheet in the sheet discharge direction by a predetermined distance in carrying the sheet onto the tray means from the sheet discharge outlet, and then rotate backward the forward/backward rotation roller to force the rear end of the carried-in sheet to strike the regulation stopper to align, while the control means releases or reduces the pressing force of the sheet pressing guide on the uppermost sheet in rotating forward the forward/backward rotation roller using the pressing force reducing means, thereby moves forward the carried-in sheet and the uppermost sheet in the sheet discharge direction by a predetermined distance, and then, by the reverse rotation of the forward/backward rotation roller, concurrently moves backward the carried-in sheet and the uppermost sheet to the regulation stopper.

In the invention, after moving forward a sheet that is carried in the tray by the forward/backward rotation roller disposed on the tray means in the sheet discharge direction by a predetermined distance, in rotating reversely the roller and guiding the sheet rear end to strike the regulation stopper to align by the sheet pressing guide, the pressing force of the sheet pressing guide on the uppermost sheet is released or reduced in moving forward the sheet along the tray in the sheet discharge direction by a predetermined distance, the uppermost sheet is thereby moved forward together with the carried-in sheet, and then, the carried-in sheet and the uppermost sheet are concurrently moved backward to the regulation stopper by reverse rotation of the forward/backward rotation roller. Therefore, the invention has the following effects.

In the invention, in moving forward a carried-in sheet along the tray, the uppermost sheet on the tray is also fed in the same direction, and then, the carried-in sheet and the uppermost sheet are fed backward. Therefore, the sheet carried onto the tray causes neither a sheet jam by the sheet pressing guide, nor front-end folding. In other words, the end edge of the uppermost sheet is neither curved nor becomes deformed by being seized by the stopper when the carried-in sheet is moved backward to the regulation stopper, and it is thereby possible to smoothly feed the carried-in sheet between the sheet pressing guide and the uppermost sheet.

Further, the invention enables a sheet to be carried out in the forward direction and the backward direction with reliability by the forward/backward rotation roller disposed on the tray, in loading and storing the sheet from the sheet discharge outlet. Therefore, the sheet is prevented from being carried out of the sheet discharge outlet incompletely and from causing a sheet jam. Further, the carried-out sheet does not fly outside the tray. Furthermore, the sheet on the tray means strikes in the state of being pressed lightly against the rear-end regulation stopper by the sheet pressing guide, and does not result in alignment failure by effects of rising, curling and the like.

BRIEF DESCRIPTION OF THE SEVERAL VIEWS OF THE DRAWINGS

FIG. 4 shows a sheet pressing guide in the post-processing apparatus in FIG. 2, where

DETAILED DESCRIPTION OF THE INVENTION

Figure 1:
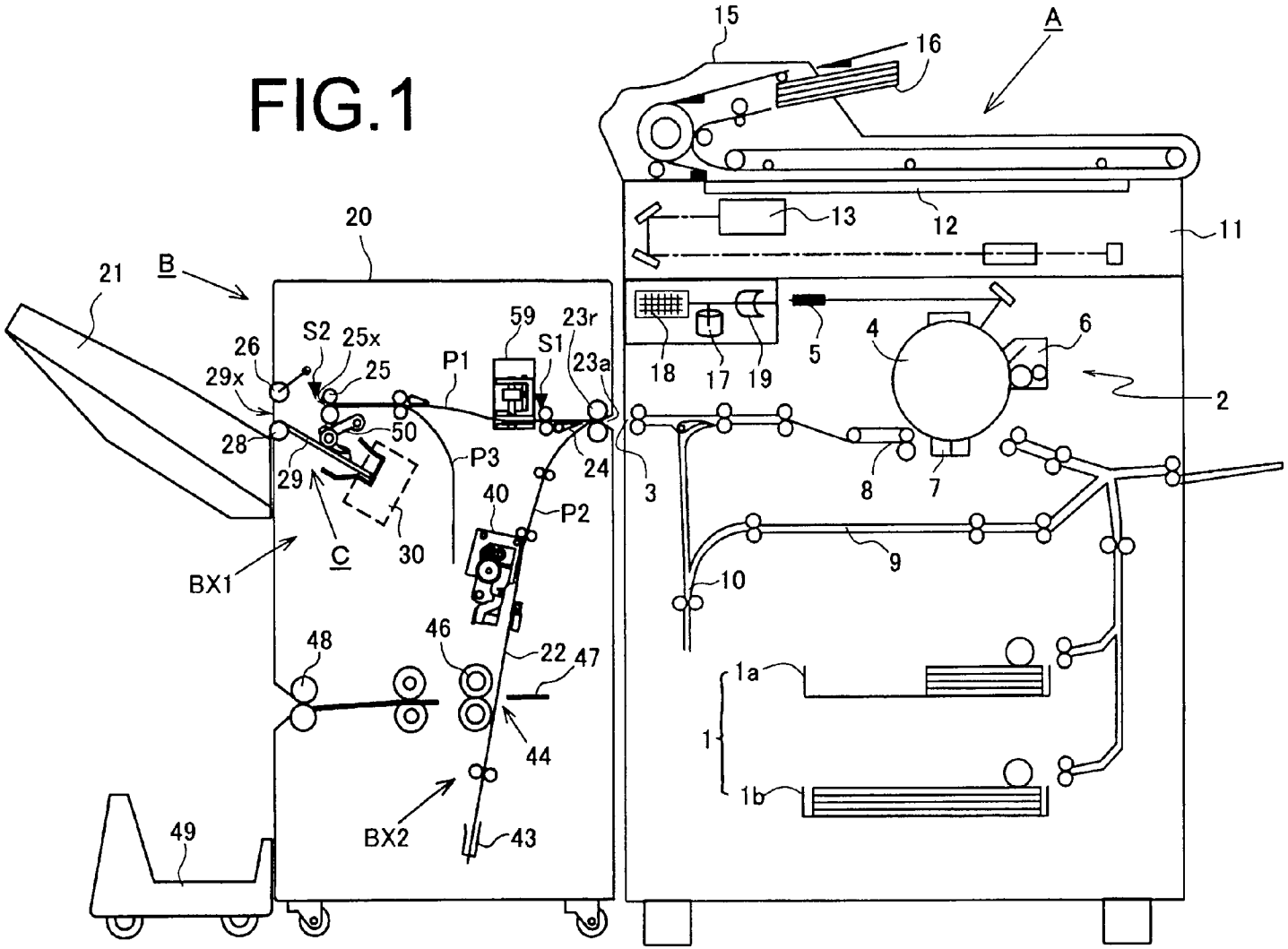
FIG. 1 is an explanatory view of an entire configuration of an image formation system according to the invention.
Figure 2:
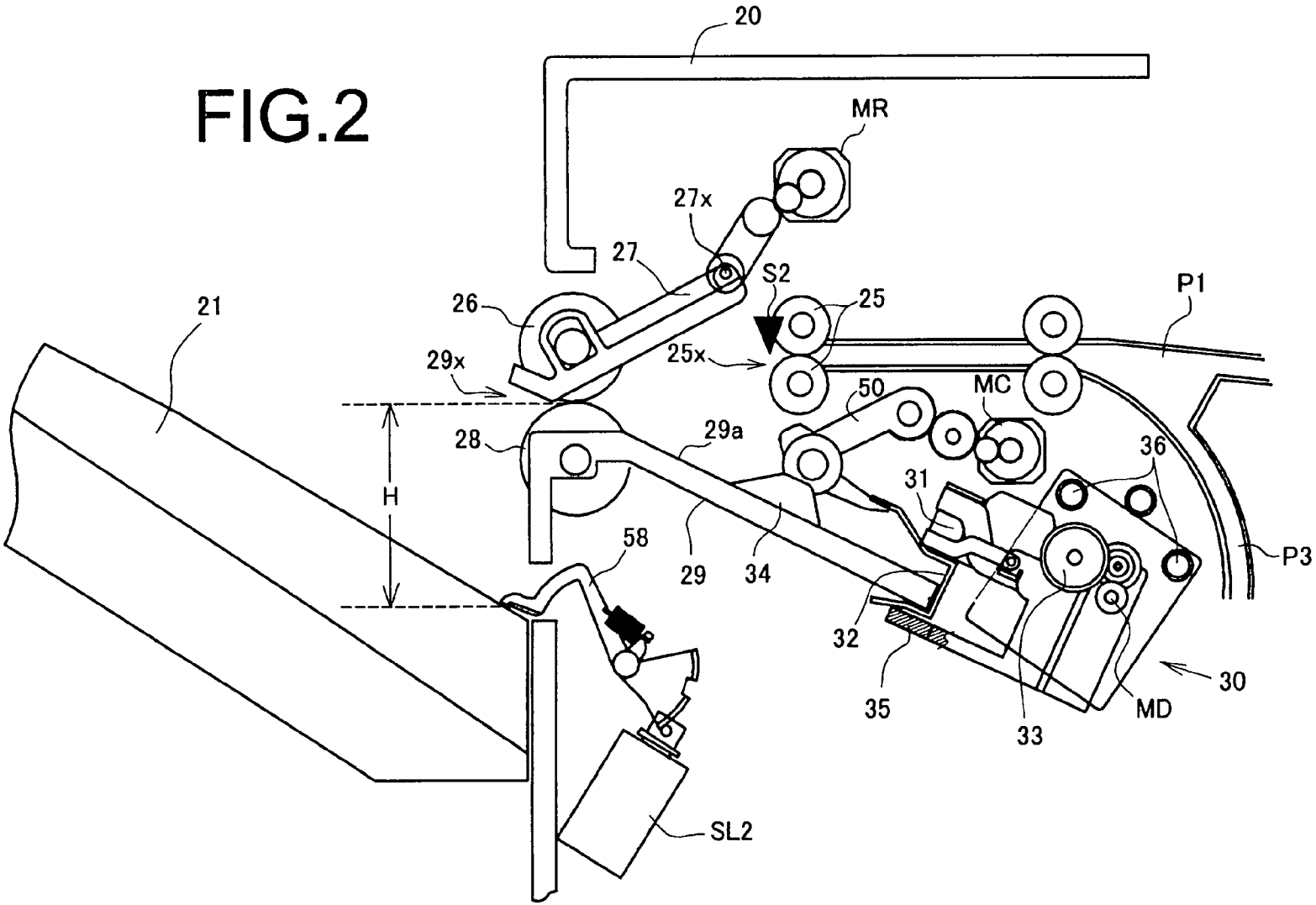
FIG. 2 shows a part of a post-processing apparatus in the system of FIG. 1 and is an explanatory view of a detailed structure of a sheet collecting apparatus (unit)

The present invention will specifically be described below based on preferred embodiments shown in drawings. FIG. 1 is an explanatory view of an entire configuration of an image formation system provided with a sheet collecting apparatus according to the invention, and FIG. 2 shows a part of a post-processing apparatus in the system of FIG. 1 and is an explanatory view of a detailed structure of the sheet collecting apparatus (unit).

[Image Forming System]

An image formation system as shown in FIG. 1 is formed of an image formation apparatus A and post-processing apparatus B, and a sheet collecting apparatus C is built into the post-processing apparatus B as a sheet collecting unit. Then, a carry-in entrance 23*a* of the post-processing apparatus B is coupled to a sheet discharge outlet 3 of the image formation apparatus A, and it is configured that sheets with images formed thereon in the image formation apparatus A are stapled in the post-processing apparatus B and stored in a stack tray 21 and saddle tray 49. The sheet collecting unit C is built into the post-processing apparatus B as a unit for collecting the image-formed sheets supplied to the carry-in entrance 23*a* in bunch form for each set. Each apparatus configuration will be described below.

[Image Formation Apparatus]

As shown in FIG. 1, the image formation apparatus A is configured so that a sheet is fed to an image formation section 2 from a sheet feeding section 1, printed in the image formation section 2, and discharged from a sheet discharge outlet 3. In the sheet feeding section 1, sheets with different sizes are stored in paper cassettes 1*a* and 1*b*, and designated sheets are separated on a sheet basis and fed to the image formation section 2. In the image formation section 2 are arranged, for example, an electrostatic drum 4, and a print head (laser emitter) 5, developer 6, transfer charger 7 and fuser 8 disposed around the drum, an electrostatic latent image is formed on the electrostatic drum with the laser emitter 5, the developer 6 adds toner to the image, and the image is transferred onto the sheet with the transfer charger 7, and heated and fused with the fuser 8. The sheet with the image thus formed is sequentially carried out from the sheet discharge outlet 3. Reference numeral 9 shown in the figure denotes a circulating path, and is a path for two-side printing for reversing the side of the sheet with printing on its front side from the fuser 8 via a switch-back path 10, and feeding the sheet again to the image formation section 2 so as to print on the back side of the sheet. The side of the two-side printed sheet is reversed in the switch-back path 10, and the sheet is carried out from the sheet discharge outlet 3.

Reference numeral 11 shown in the figure denotes an image reading apparatus, where an original document sheet set on a platen 12 is scanned with a scan unit 13, and electrically read with a photoelectric conversion element not shown. The image data is subjected to, for example, digital processing in an image processing section, and then transferred to a data storing section (not shown), and an image signal is sent to the laser emitter 5. Further, reference numeral 15 shown in the figure is an original document feeding apparatus, and is a feeder apparatus for feeding an original document sheet stored in a paper tray 16 to the platen 12.

Figure 7:
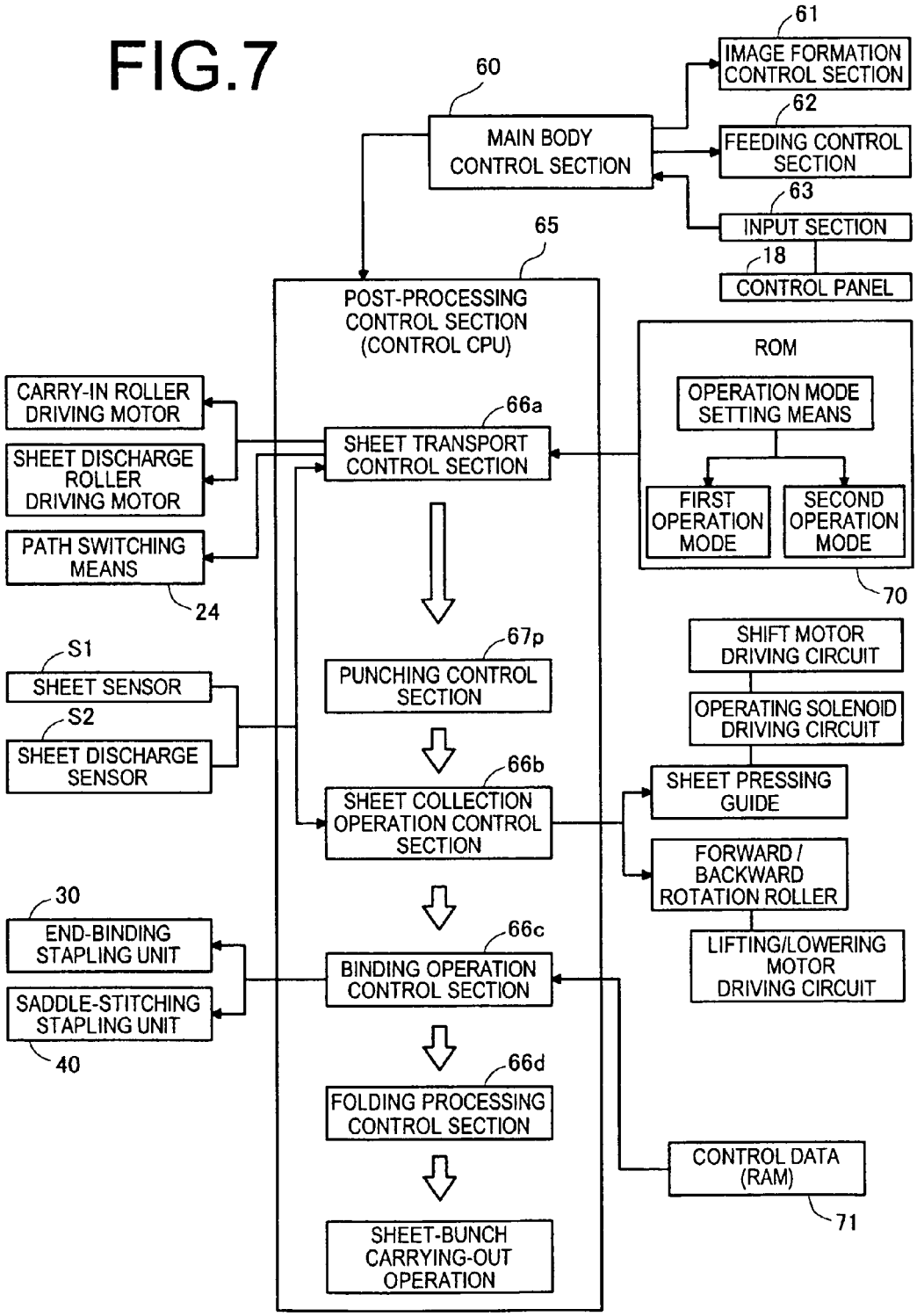
FIG. 7 is a block diagram illustrating a control configuration of the image formation system in the apparatus in FIG. 1.

The image formation apparatus A with the above-mentioned configuration is provided with a control section 60 as shown in FIG. 7, and is set for image formation/printing conditions such as, for example, sheet size designation, color/monochrome printing designation, number-of-printed sheet designation, one-side/two-side printing designation, scaling printing designation and the like from a control panel 18. Meanwhile, it is configured in the image formation apparatus A that image data read by the scan unit 13 or image data transferred from an external network is stored in a data storing section 17, the image data is transferred to a buffer memory 19 from the data storing section 17, and that a data signal is output to the laser emitter 5 from the buffer memory 19.

A post-processing condition is also input and designated from the control panel 18, concurrently with the image formation conditions such as one-side/two-side printing, scaling printing, monochrome/color printing and the like. Selected as the post-processing condition is, for example, a "print-out-mode", "binding finish mode", "brochure finish mode" or the like.

[Configuration of the Post-Processing Apparatus]

The post-processing apparatus B is configured as described below to receive a sheet with the image formed thereon from the sheet discharge outlet 3 of the image formation apparatus A, and to (i) store the sheet in the stack tray 21 ("print-out mode" as described above), (ii) collect sheets from the sheet discharge outlet 3 in the shape of a bunch for each set to staple, and store in the stack tray 21 ("binding finish mode" as described above), or (iii) collect sheets from the sheet discharge outlet 3 in the shape of a bunch for each set, staple its center, fold in the shape of a brochure and store in the saddle tray 49 ("brochure finish mode" as described above).

A casing (exterior cover) 20 of the post-processing apparatus B is provided with the carry-in entrance 23*a*, and the carry-in entrance 23*a* is coupled to the sheet discharge outlet 3 of the image formation apparatus A. In the casing 20 are provided a first processing section BX1 that collects sheets from the carry-in entrance 23*a* for each set to perform a binding finish, and a second processing section BX2 that collects sheets from the carry-in entrance 23*a* for each set to perform a brochure finish. A first carry-in path P1 is provided between the first processing section BX1 and the carry-in entrance 23*a*, and a second carry-in path P2 is provided between the second processing section BX2 and the carry-in entrance 23*a*, so that the sheet from the carry-in entrance 23*a* is distributed and guided to the first processing section BX1 or the second processing section BX2. Further, the carry-in entrance 23*a* is provided with a carry-in roller 23*r*, sheet sensor S1, and path switching means (flapper member) 24 that distributes the sheet to the first or second carry-in path P1 or P2.

The first carry-in path P1 is disposed substantially in the horizontal direction in the upper portion of the apparatus housing formed of the casing 20, the first processing section BX 1 is disposed on the downstream side of the first carry-in path P1, and the stack tray 21 is disposed on the downstream side of BX1. Meanwhile, the second carry-in path P2 is disposed substantially in the vertical direction in the lower portion of the casing 20, the second processing section BX2 is disposed on the downstream side of the second carry-in path P2, and the saddle tray 49 is disposed on the downstream side of BX2.

In the first carry-in path P1 as shown in FIG. 1, a punch unit 59 is disposed between the carry-in entrance 23*a* and the first processing section BX1, and punches filing holes in a sheet to feed to the first processing section BX1. Further, a buffer path P3 is provided between the punch unit 59 and the processing tray 29. A subsequent sheet fed to the carry-in entrance 23*a* during the operation of performing post-processing such as stapling binding or the like is temporarily held in the buffer path P3.

[Configuration of the First Processing Section]

Described first is a configuration of the first processing section BX1 as described above. The first processing section BX1 collects sheets from the first carry-in path P1 for each set, and performs post-processing on a bunch of sheets to store on the stack tray 21. Therefore, a level difference is formed in the sheet discharge outlet 25*x* of the first carry-in path P1 to provide the processing tray (tray means; which is the same in the following description) 29, and the stack tray 21 is disposed on the downstream side of the processing tray 29 (see FIG. 2).

The sheet discharge roller 25 and sheet discharge sensor S2 are disposed in the sheet discharge outlet 25*x* of the first carry-in path P1. The sheet discharge sensor S2 is provided to detect a sheet passed through the first carry-in path P1 so as to detect a jam and count the number of passed sheets. The processing tray 29 is formed of a synthetic resin plate or the like, and forms a sheet mount surface (tray surface) 29*a* for bearing and supporting sheets.

The sheet mount surface 29*a* is formed in dimensions longer than the length in the sheet discharge direction of the maximum sheet that can be stored to mount and support the entire length of the sheet from the sheet discharge outlet 25*x*, or is configured in dimensions shorter than length in the sheet discharge direction of the maximum sheet that can be stored as shown in the figure. The apparatus as shown in the figure is characterized in that a sheet from the sheet discharge outlet 25*x* is supported in the shape of a bridge with its front end portion in the sheet discharge direction by the stack tray 21 and its rear end portion by the processing tray 29. By this bridge support structure, it is intended to make the apparatus small-size and compact.

In the processing tray 29 configured as described above are disposed a forward/backward rotation roller 26 for collecting the sheet sent from the sheet discharge outlet 25*x* in a predetermined position of the sheet mount surface 29*a* and rear-end regulation stopper 32. The forward/backward rotation roller 26 is disposed above the processing tray 29 to be able to move up and down between an operating position (state in FIG. 2) for coming into contact with the sheet mount surface 29*a* and a standby position (state in FIG. 1) for separating upward from the sheet mount surface 29*a*. Therefore, the forward/backward rotation roller 26 is supported by a lifting/lowering arm 27 supported by a support shaft 27*x* in the apparatus frame. Then, the forward/backward rotation roller 26 is coupled to a forward/backward rotation motor not shown, and by this motor, the forward/backward rotation roller 26 is driven to rotate in the clockwise direction (sheet discharge direction) and the counterclockwise direction (opposite to the sheet discharge direction) as viewed in FIG. 2. Concurrently therewith, the forward/backward rotation roller 26 moves up and down between the operating position and the standby position by a lifting/lowering motor MR (that can be a solenoid) coupled to the support shaft 27*x* of the lifting/lowering arm 27.

Meanwhile, in the sheet mount surface 29*a* of the processing tray 29 is disposed a driven roller 28 in a position opposed to the forward/backward rotation roller 26. The driven roller 28 is provided to reduce resistance when a sheet enters the processing sheet 29 or a processed sheet bunch on the tray is transferred to the stack tray 21.

The rear-end regulation stopper 32 is disposed in the rear end portion (upstream side in the sheet discharge direction) of the processing tray 29. The rear-end regulation stopper 32 is formed of a regulation member having a stopper surface which the rear end edge of the sheet strikes to be regulated. Then, the sheet entering onto the processing tray is switched back by the forward/backward rotation roller 26 so that the rear end of the sheet is regulated by striking. Side aligning plates 34 are disposed in the processing tray 29. The aligning plates 34 position and align the side end edges of the sheet on the processing tray 29 in a beforehand set reference (side reference or center reference). Although a structure of the plates is not described specifically, for example, a pair of aligning plates are provided in opposite end portions on the processing tray, and when the right and left aligning plates are moved in opposite directions in synchronization with each other to close and separate, side alignment is made with reference to the sheet center. Meanwhile, when one of the right and left aligning plates is fixed and the other plate closes and separates from the fixed alignment plate, side alignment is made with reference to the side.

Described next is the post-processing means 30 disposed in the processing tray 29. The post-processing means 30 as shown in FIG. 2 is formed of a stapling unit for binding a bunch of sheets collected on the tray. The stapling unit 30 is formed of a driver 31 and clincher 35. The driver 31 is formed of a head member that inserts a staple into a bunch of sheets set in a binding position, cartridge for storing staples, driver cam 33, and staple motor MD for driving the driver cam 33. The clincher 35 is disposed in a position opposed to the driver 31 with a bunch of sheets therebetween, and formed of a bend groove to bend the front end of the staple inserted into the bunch of sheets.

The post-processing means (stapling unit) 30 is supported by a guide rod 36 in the apparatus frame to be able to move to positions in the sheet width direction, and is configured to move to positions by a control motor not show. By this means, using a single stapling unit 30, it is possible to staple two right and left portions in the sheet side edge, or a sheet corner.

A sheet pressing guide 50 is disposed between the rear-end regulation stopper 32 and forward/backward rotation roller 26. The sheet pressing guide 50 is to press from above the rear end edge of the sheet which is switch-backed and transported to the rear-end regulation stopper 32 so as to prevent the rear end edge from curving upward and rising. In other words, when the forward/backward rotation roller 26 forces the sheet rear end to strike the rear-end regulation stopper 32 to regulate, a curled sheet or a soft sheet is sometimes curved upward and raised above the stopper. Therefore, the guide member is required to press the sheet end portion forced to strike the rear-end regulation stopper 32 from above.

[Sheet Pressing Guide]

Figure 4A:
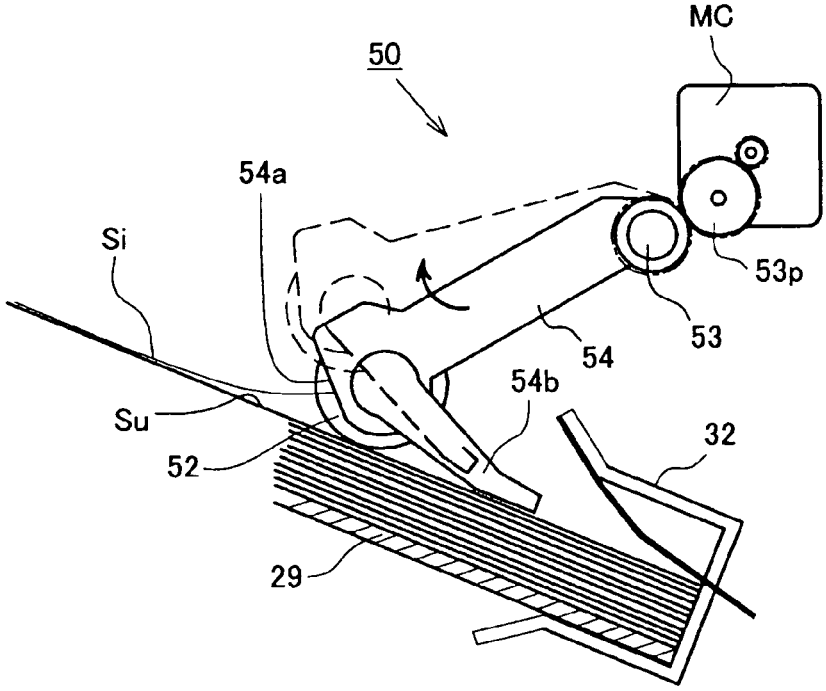
FIG. 4A is an explanatory view of a first embodiment.

An embodiment (first embodiment) of the sheet pressing guide 50 will be described based on FIG. 4A. This guide member is formed of a roller member or plate member for pressing the uppermost sheet Su on the processing tray 29. FIG. 4A shows the case of pressing the uppermost sheet Su on the processing tray by a roller member. A shaking arm 54 is supported by a support shaft 53 in the apparatus frame, and a guide roller 52 is axially supported by the shaking arm 54 to be rotatable. Then, the shaking arm 54 is provided at its base end portion with an integrally-formed sector-shaped gear meshing with a pinion 53*p* coupled to a guide shift motor MC. Accordingly, by forward and backward rotation of the shift motor MC, the guide roller 52 is able to move vertically between a position for coming into contact with the uppermost sheet Su on the processing tray and a withdrawal position for withdrawing above. Then, the guide roller 52 is provided on its front end side with a guide piece 54*b* for guiding the sheet rear end portion fed toward the rear-end regulation stopper 32, and is provided on its rear end side with a carry-in guide 54*a* for guiding the sheet to between the guide roller and the uppermost sheet Su, where the guide 54*a* is integrally formed in the shaking arm 54.

In such a configuration, the guide roller 52 always presses the uppermost sheet Su on the processing tray 29 by a predetermined pressure under its own weight, and when the shaking arm 54 is shaken in the clockwise direction in FIG. 4A by rotation of the shift motor MC, the pressing force of the guide roller 52 on the uppermost sheet Su is released. In this case, for example, by providing an adjuster spring (connecting spring) in between the shift motor MC and pinion 53*p*, it is possible to reduce the pressing force of the guide roller 52 on the uppermost sheet Su.

Figure 4B:
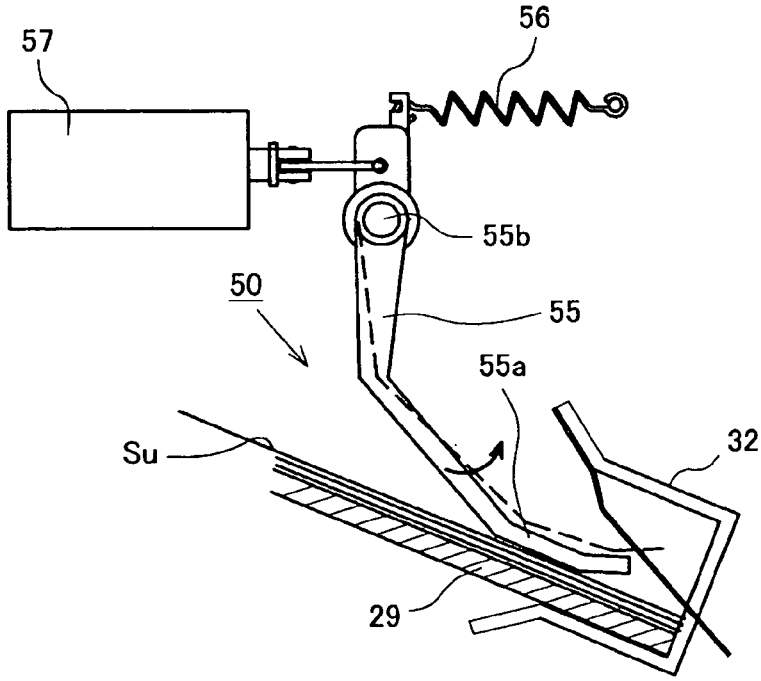
FIG. 4B shows an explanatory view of a second embodiment.

A second embodiment of the sheet pressing guide 50 will be described next based on FIG. 4B. FIG. 4B shows the case that the pressing guide is formed of a plate-shaped member. A support shaft 55*b* is provided in the apparatus frame, and a plate-shaped guide member 55 is attached to the support shaft 55*b* to be shakable. Then, the front end portion of the plate-shaped guide member 55 is integrally provided with a sheet pressing piece 55*a* for pressing the uppermost sheet Su on the processing tray from above. Further, the base end portion of the guide member 55 is coupled to a biasing spring 56, and it is configured that the sheet pressing piece 55*a* always presses the uppermost sheet by a predetermined pressure. Then, the base end portion of the guide member 55 is coupled to an operating solenoid (shift solenoid) 57 to shake the guide member 55 so that the sheet pressing piece 55*a* separates from the uppermost sheet.

In such a configuration, the sheet pressing piece 55*a* always presses the uppermost sheet Su on the processing tray by a predetermined pressure, and when the operating solenoid 57 is actuated, the pressing force of the sheet pressing piece 55*a* is released. In this case, for example, by providing a spring in between the operating solenoid and guide member 55, it is possible to reduce the pressing force of the sheet pressing piece 55*a* without releasing the force (state of pressing force of zero).

The processing tray 29 is provided with a sheet-bunch carrying-out means (not shown) for carrying out the processed sheet bunch to the stack tray 21 on the downstream side. The sheet-bunch carrying-out means is disposed at the bottom of the processing tray 29, and is formed of a sheet engagement member (grip member) for protruding above the sheet mount surface 20*a* to engage in a sheet bunch, and a carrier member such as a belt for moving the sheet engagement member from the right end to the left end as viewed in FIG. 2 along the processing tray 29. The sheet bunch subjected to the post-processing such as stapling in the processing tray 29 is carried out of a sheet discharge outlet 29*x* of the processing tray 29 to the stack tray 21.

[Lifting/Lowering Mechanism of the Stack Tray]

A configuration of the stack tray 21 will be described below according to FIG. 3. The stack tray 21 is configured to move up and down corresponding to a load amount of sheets. The stack tray 21 is formed in the shape of a tray for holding sheets, and configured to protrude outside the apparatus from the side wall of the casing 20. Therefore, as shown in FIG. 3, a tray base end portion 21*a* is provided at its lower and upper portions with two guide rollers 20*r*, and the guide rollers 20*r* are fitted and supported with a guide rail 20*u* provided in the apparatus frame (not shown).

Then, the stack tray 21 is installed in its bottom with a lifting/lowering motor MS, and a driving pinion 21*p* is coupled to the lifting/lowering motor MS via a reduction mechanism. Meanwhile, in the apparatus frame provided with the guide rail 20*u* is disposed a rack gear 20*h* in the sheet load direction (vertical direction as viewed in FIG. 3), and the driving pinion 21*p* meshes with the rack gear 20*h*. Meanwhile, the lifting/lowering motor MS is formed of a motor capable of rotating forward and backward, and its driving shaft is provided with an encoder (not shown) for detecting the amount of rotation. Further, the stack tray 21 is provided with a level sensor Sr for detecting a height position of the uppermost sheet loaded on the stack tray 21. Accordingly, the stack tray 21 moves to positions in the sheet load direction (vertical direction as viewed in FIG. 3) by rotating the lifting/lowering motor MS forward and backward by a predetermined amount. Then, the level sensor Sr detects a height position of the stack tray 21, and based on the detection result, the lifting/lowering motor MS is driven and rotated forward or backward. The amount of rotation of the lifting/lowering motor MS is detected by the encoder.

[Configuration of the Level Sensor]

Figure 3:
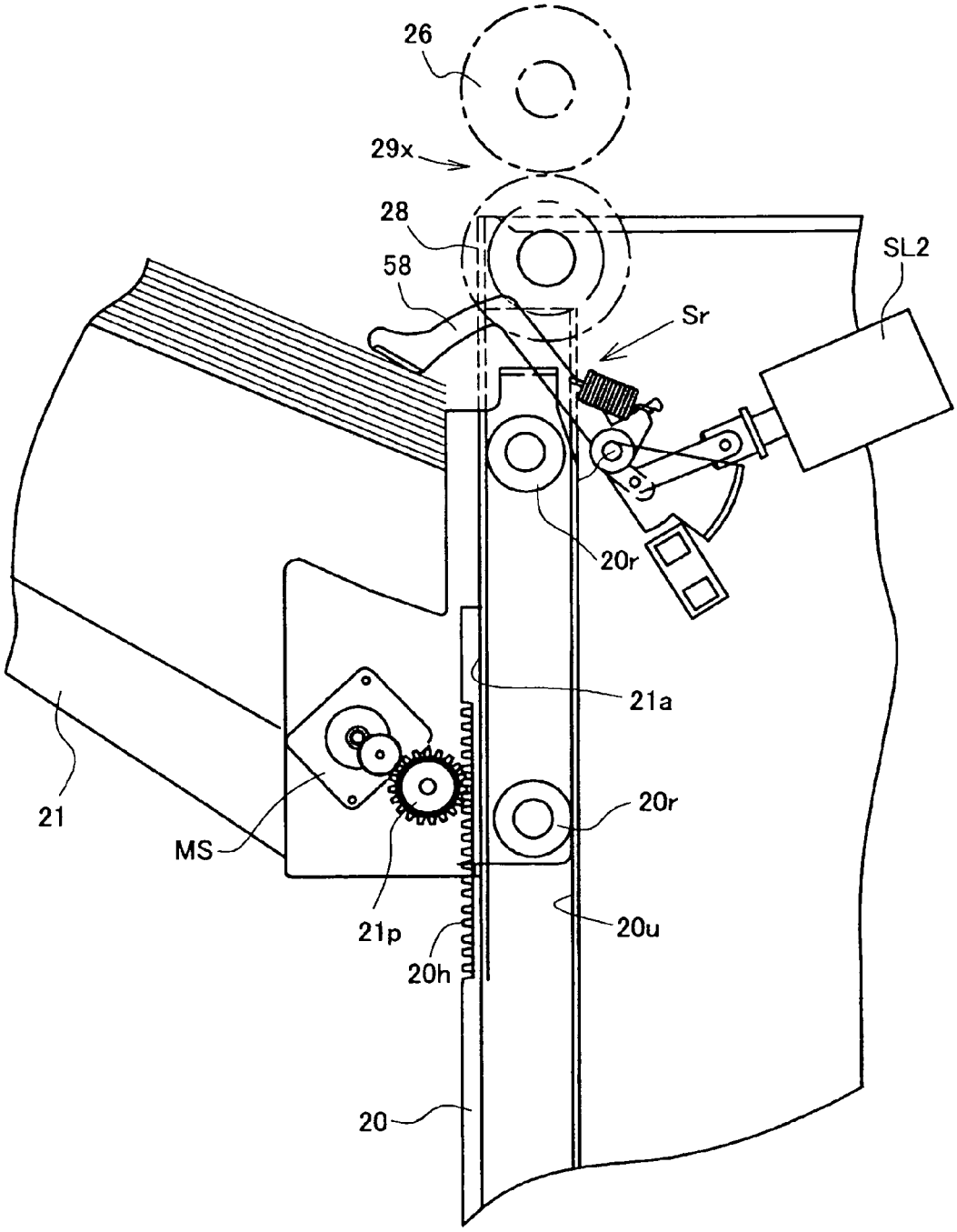
FIG. 3 is an explanatory view of a lifting/lowering mechanism of a stack tray in the post-processing apparatus in FIG. 2.

As shown in FIGS. 2 and 3, the level sensor Sr is formed of an arm lever 58, and a sensor for detecting a position of the arm lever 58, and the arm lever 58 is coupled to an operating solenoid SL2. Then, a lifting/lowering means (control CPU) moves the arm lever 58 up and down with a sheet discharge instruction signal. The sheet discharge instruction signal is notified at timing after a lapse of predicted time that a sheet reaches the stack tray 21, for example, after a rear end pass signal of the sheet from the sheet discharge sensor S2. Meanwhile, the stack tray 21 is moved up and down with a timing signal after a lapse of predicted time that a rear end of a bunch of sheets reaches the stack tray 21 after an operation signal of the bunch carrying-out means described previously.

Then, with respect to a difference H between the uppermost sheet stored on the up-and-down tray 21 and the sheet mount surface 29*a* of the processing tray 29, the lifting/lowering control means (control CPU as described later) sets the height difference H substantially at "height difference H=zero" when the sheet is loaded and stored on the processing tray 29 (post-processing finish mode). Meanwhile, when a sheet from the sheet discharge outlet 25*x* is directly carried out to the stack tray 21 without collecting on the processing tray 29 "straight sheet discharge mode", the means sets "height difference H>zero". Further, when a bunch of sheets collected on the processing tray 29 is carried out of the sheet discharge outlet 29*x* to the stack tray 21 after the post-processing, the means sets "height difference H>>zero".

[Configuration of the Second Processing Section]

The second processing section BX2 is formed of a collection guide 22 disposed in the second carry-in path P2, and a saddle-stitching stapling unit 40 and folding processing mechanism 44 disposed in the collection guide 22. The collection guide 22 disposed on the downstream side of the second carry-in path P2 is configured to bear and store sheets from the carry-in entrance 23*a* in the upright position. The collection guide 22 is in the shape of being curved in the center, and is formed in the shape with the length for accommodating the maximum-size sheet therein. In the collection guide 22 are disposed the saddle-stitching stapling unit 40 and folding processing mechanism 44.

Further, the front end portion of the guide is provided with a front end stopper 43 for regulating the sheet front end, and is disposed to be able to move to positions corresponding to the sheet size (length in the sheet discharge direction).

The saddle-stitching stapling unit 40 has substantially the same configuration as that of the stapling unit 30 as described previously and descriptions thereof are omitted. In this unit, the driver mechanism and clincher mechanism are separate and thus formed so that a sheet bunch to staple is passed through the center. The other configuration is the same as in the unit described previously.

The folding processing mechanism 44 is formed of a fold roll means 46 for folding a bunch of sheets collated for each set in the collocation guide 22, and a fold blade 47 for inserting the bunch of sheets into a nip position of the fold roll means 46. The fold roll means 46 is comprised of a pair of rolls formed of material with a relatively high coefficient of friction such as a rubber roller and the like. Further, the fold blade 47 is able to reciprocate in the orthogonal direction to the collection guide 22 to insert a fold position of the sheet bunch into the nip position of the fold roll means 46, and is coupled to an actuating means (motor, solenoid, etc.) not shown. Reference numeral 48 shown in the figure is a sheet discharge roller, and carries out the sheet bunch folded in the fold roll means 46 to the saddle tray 49.

[Explanation of the Control Configuration]

The control configuration of the image formation system as described above will be described below according to a block diagram of FIG. 7. The image formation system as shown in FIG. 1 is provided with a control section (hereinafter referred to as a "main body control section") 60 of the image formation apparatus A and a control section (hereafter referred to as a "post-processing control section") 65 of the post-processing apparatus B. The main body control section 60 is provided with an image formation control section 61, feeding control section 62 and input section 63. Then, the settings of "image formation mode" and "post-processing mode" are made from the control panel 18 provided in the input section 63. As described previously, the image formation mode is to set image formation conditions such as the number of print out sets, sheet size, color/monochrome printing, scaling printing, one-side/two-side printing and others. Then, the main body control section 60 controls the image formation control section 61 and feeding control section 62 corresponding to the set image formation conditions, forms an image on a predetermined sheet, and then, sequentially carries out the sheet from the main-body sheet discharge outlet 3.

Concurrently therewith, the post-processing mode is set by input from the control panel 18. For example, the "print-out mode", "end binding finish mode", or "sheet-bunch folding finish mode" is set as the post-processing mode. Then, the main body control section 60 transfers the finish mode of post-processing, the number of sheets, information of the number of sets, and binding mode (one-portion binding, two-portion binding, or multiple-portion binding) information to the post-processing control section 65. Concurrently therewith, the main body control section 60 transfers a job finish signal to the post-processing control section 65 whenever image formation is completed.

[Post-Processing Control Section]

The post-processing control section 65 is provided with the control CPU 65 for operating the post-processing apparatus B corresponding to the designated finish mode, ROM 70 for storing an operation program, and RAM 71 for storing control data. Then, the control CPU 65 is comprised of a "sheet transport control section 66*a*" for executing transport of a sheet sent to the carry-in entrance 23*a*, "punching control section 67*p*" for punching punched holes in a sheet from the image formation apparatus A, "sheet collection operation control section 66*b*" for controlling collection of sheets for each set to the processing tray 29, "binding operation control section 66*c*" for performing binding processing on a bunch of sheets collected on the processing tray 29, and "folding processing control section 66*d*" for performing folding processing on a bunch of sheets collected in the collection guide 22.

[Sheet Transport Control Section]

The sheet transport control section 66*a* is coupled to a control circuit of a driving motor (not shown) of the sheet discharge roller 25 of the first carry-in path P1, and is configured to receive a detection signal from the sheet sensor S1 disposed in the first carry-in path P1. The sheet transport control section 66*a* controls the path switching means 24 corresponding to the post-processing mode for the sheet from the carry-in entrance 23*a*. This control is configured to guide a sheet to the first carry-in path P1 when the post-processing mode set in the image formation apparatus A is the "print-out mode" or "end binding finish mode". In this control, the carry-in roller 23*r* and sheet discharge roller 25 are driven to rotate in the sheet discharge direction with a sheet discharge designation signal from the image formation apparatus A, and the path switching means 24 is operated to guide the sheet to the first carry-in path P1 based on a sheet detection signal from the sheet sensor S1. Meanwhile, when the "sheet-bunch folding finish mode" is selected as the post-processing mode, the path switching means 24 is operated to guide the sheet to the second carry-in path P2.

[Punching Control Section]

The punching control section 67*p* is configured to punch punched holes in a sheet guided to the first carry-in path P1 when the post-processing mode is set at "punching punched holes in the print-out mode" or "punching punched holes in the end binding finish mode".

[Sheet Collection Operation Control Section]

The sheet collection operation control section 66*b* is configured to control the forward/backward rotation roller 26 and the sheet pressing guide 50 when the post-processing mode is set at the "print-out mode" or "end binding finish mode". The sheet collection operation control section 66*b* is connected to a driving circuit of the lifting/lowering motor MR provided in the forward/backward rotation roller 26 to collect sheets on the processing tray 29, the shift motor MC provided in the sheet pressing guide (guide roller 52, guide member 55) 50, and a driving circuit of the operating solenoid (shift solenoid) 57.

Then, the section 66*b* moves the forward/backward rotation roller 26 from the standby position to the sheet engagement position by a detection signal from the sheet discharge sensor S2 disposed in the sheet discharge outlet 25*x* so as to transfer a sheet carried onto the processing tray 29 to the stack tray 21 side. Then, after a lapse of predicted time that the sheet rear end is carried onto the processing tray, the section 66*b* reverses rotation of the forward/backward rotation roller 26 to feed the sheet to the rear-end regulating means 32 disposed in the processing tray 29. The control of the forward/backward rotation roller 26 will be described later.

Further, the sheet collection operation control section 66*b* is coupled to a driving circuit of an operating motor (alignment operating motor; not shown) of the aligning plates 34 disposed on the processing tray 29. Then, it is configured that the width of the sheet fed by the alignment roller 26 is aligned by the aligning plates 34. Therefore, the sheet collection operation control means 66*b* causes the right and left aligning plates to reciprocate in the sheet width direction in a predetermined range corresponding to the sheet size.

[Binding Operation Control Section]

The binding operation control section 66*c* is configured to control the stapling means (end-binding stapling unit) 30, bunch carrying-out means (not shown) and lifting/lowering motor MS of the stack tray 21 when the post-processing mode is set at the "end binding finish mode".

Figure 9:
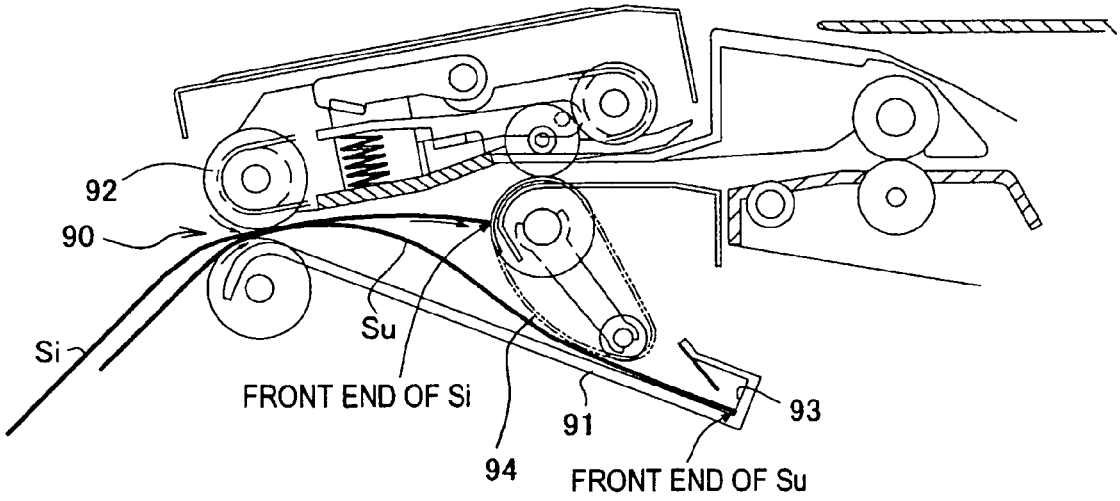
FIG. 9 is an explanatory view of conventional technique showing a sheet collected state in a conventional sheet collected structure.

Therefore, in regard to the problem that in collecting a sheet (hereinafter, referred to as a carried-in sheet Si) from the first carry-in path P1 to the processing tray 29, the uppermost sheet Su already stored on the processing tray interferes with normal alignment action of the carried-in sheet Si, the invention is characterized by solving the problem as described below. As described previously based on FIG. 9, in the conventional apparatus, when a carried-in sheet Si is fed toward the regulation stopper by the roller on the processing tray, the uppermost sheet Su on the processing tray is curved, rises upward, thereby prevents the carried-in sheet Si from proceeding, and results in a jam and front-end folding. This is caused by the fact that the center portion of the uppermost sheet on the processing tray is curved upward by the transport force (together-feeding transport force) received from the carried-in sheet Si with the front end portion of the uppermost sheet regulated in the forward/backward direction by the regulation stopper and in the upward/downward direction by the sheet pressing guide (see FIG. 9). Therefore, in the invention, the uppermost sheet Su is fed in the sheet discharge direction together with the carried-in sheet Si in moving forward the sheet Si carried onto the processing tray, and next, with the carried-in sheet Si and uppermost sheet Su overlapped, both sheets are moved backward in the opposite direction to the sheet discharge direction to strike the regulation stopper. By this means, the uppermost sheet Su is prevented from being curved upward by the backward action of the carried-in sheet Si, and thereby does not prevent the carried-in sheet from proceeding.

Therefore, in the invention, it is configured to enable the predetermined pressure for the sheet pressing guide (guide roller 52 in FIG. 4A and sheet pressing piece 55*a* in FIG. 4B; hereinafter, referred to as "guide means") to press the uppermost sheet Su to be reduced or released. Then, the pressing force of the guide means 55 acting on the uppermost sheet Su is released or reduced when the forward/backward rotation roller 26 feeds forward the carried-in sheet Si in the sheet discharge direction. By this means, the uppermost sheet Su proceeds in the same direction by a predetermined distance (shift amount) by friction acting between the uppermost sheet Su and carried-in sheet Si. Then, when the carried-in sheet Si moves backward in the opposite direction to the sheet discharge direction, the uppermost sheet Su also shifts toward the stopper corresponding to a shift formed with the rear-end regulation stopper 32. The invention is characterized in that the sheet transport control section 66*a* of the control CPU 65 executes such an operation.

[Explanation of the Operation]

Figure 8:
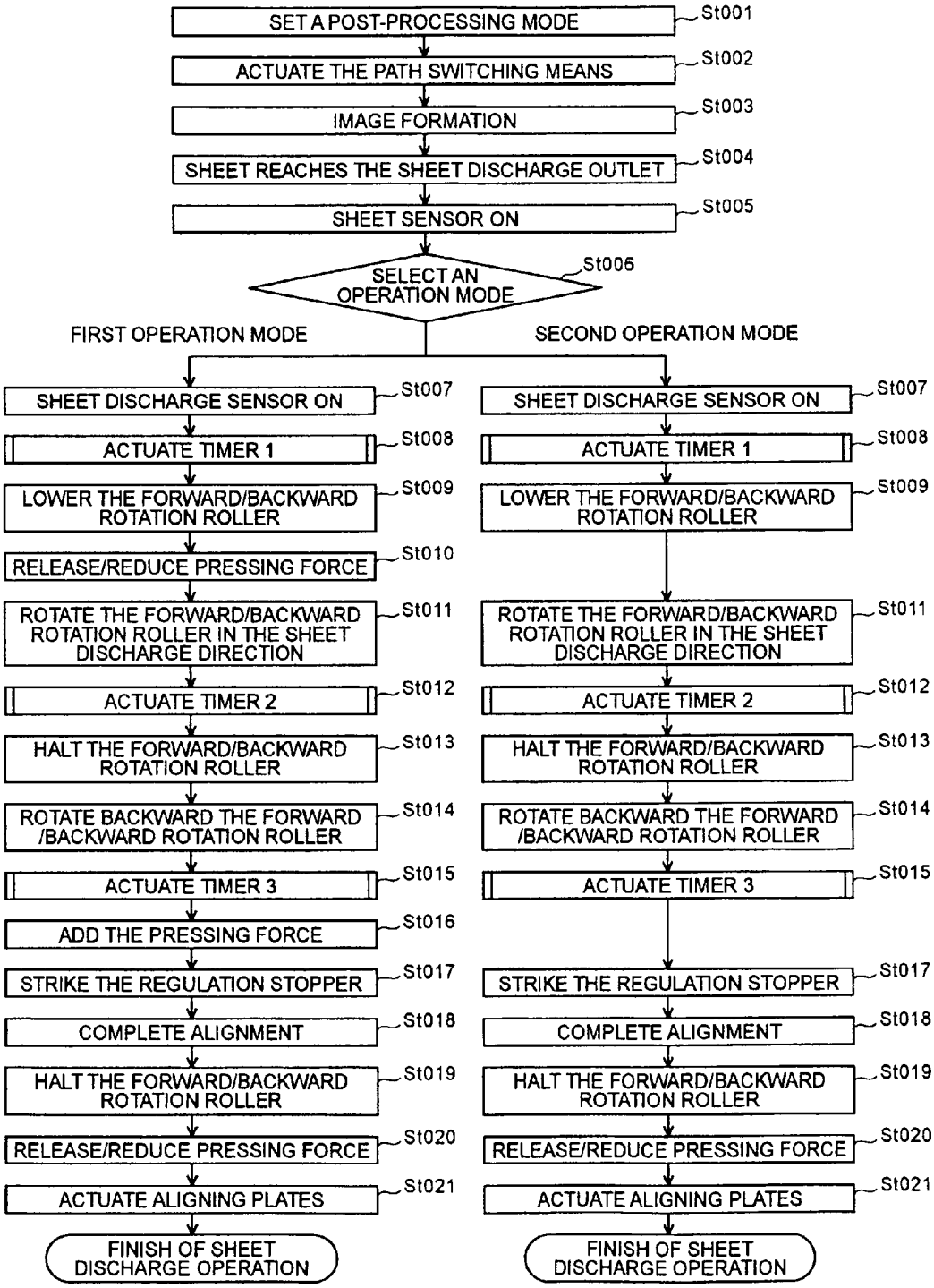
FIG. 8 is a flowchart illustrating the operation mode in the apparatus of FIG. 2.

Described next is the operation mode executed by the control CPU 65. FIG. 8 is a flowchart illustrating the operation of the control CPU 65, and FIGS. 5 and 6 are explanatory views of operating states. The image formation apparatus A is started, image formation conditions are set, and concurrently, the post-processing mode is set (St 001). Then, upon receiving the setting information of the post-processing mode from the image formation apparatus A, the control CPU 65 of the post-processing apparatus B operates the path switching means 24 to guide sheets to the first or second carry-in path P1 or P2 corresponding to the post-processing mode (St 002). At this point, when the "print-out mode" or "end binding finish mode" is set as the post-processing mode, the path switching means 24 guides sheets to the first carry-in path P1. Meanwhile, when the "sheet-bunch folding finish mode" is set, the means 24 guides sheets to the second carry-in path P2.

The invention relates to the collection mechanism for collecting sheets for each set on the processing tray 29 in the "end binding finish mode" in the apparatus configuration in the embodiment shown in the figures, and the operation in the "end binding finish mode" will be described below. When an image-formed (St 003) sheet reaches the sheet discharge outlet 3 (St 004), the control CPU 65 detects the sheet front end by the sheet sensor S1 (St 005). Using a signal from the sheet sensor S1, the control CPU 65 recognizes that the sheet enters inside the post-processing apparatus. This signal is used, for example, in detecting a sheet jam inside the first carry-in path P1.

In the sheet entering the first carry-in path P1, the front end reaches the sheet discharge roller 25, and the sheet is carried out of the sheet discharge outlet 25*x*. The sheet discharge sensor S2 detects the sheet front end. Then, with reference to the detection signal of the sheet discharge sensor S2, the control CPU 65 executes the following sheet discharge operation. In the apparatus as shown in the figures, the sheet discharge operation is executed in the "first operation mode" and the "second operation mode". Therefore, the control CPU 65 has either of the following operation mode setting means (St 006).

In a first method, the operation mode setting means is provided to select the first or second operation mode to execute corresponding to a load amount of sheets on the processing tray 29. In this case, for example, counted is the signal that the sheet discharge sensor S2 detects the sheet front end. Then, for example, sheets of pages 1 to 5 are discharged in the first operation mode, and subsequent sheets (page 6 and subsequent pages) are discharged in the second operation mode. This is because the problem as described previously occurs frequently when one or several sheets are loaded on the processing tray 29.

In a second method, the operation mode setting means is provided to select the first or second operation mode to execute corresponding to properties of sheets. For example, an operator (service man) inputs properties of sheets such as, for example, "sheet thickness information", "sheet size information", and "paper quality" from the control panel 18. Then, based on the information, the first or second operation mode is selected. This is because the problem as described previously occurs frequently when the sheet size is large, the sheet thickness is thin, and/or the paper quality tends to curl. Thus, the control CPU 65 is provided with the operation mode setting means for selecting the first or second operation mode to execute.

[First Operation Mode]

Figure 5A:
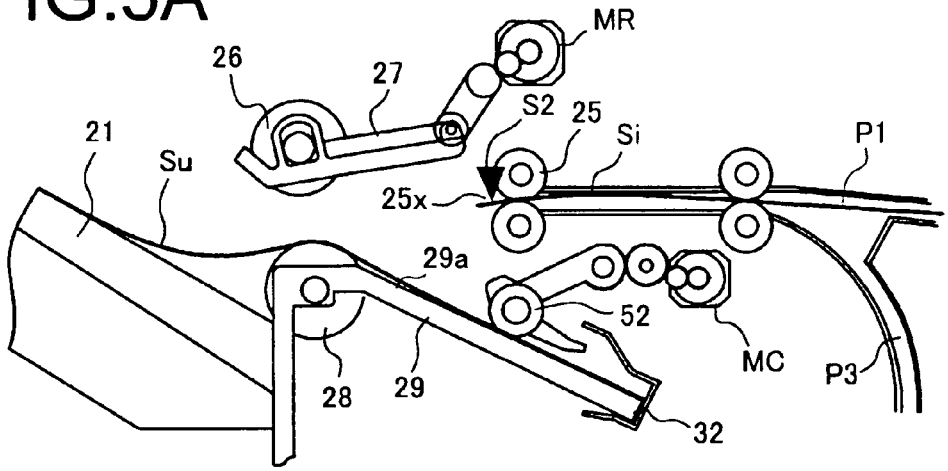
FIG. 5 contains FIGS. 5A to 5C showing operating state explanatory views in the apparatus in FIG. 2.

When the operation mode setting means sets the first operation mode, the control CPU 65 executes the following first operation mode. The sheet discharge sensor S2 detects the sheet front end (St 007). A beforehand set timer 1 is actuated with reference to the signal (St 008). This timer 1 is set for the predicted time that the sheet front end reaches the forward/backward rotation roller 26 on the processing tray. This state is shown in FIG. 5A, where the sheet front end is passed through the sheet discharge sensor S2 from the first carry-in path P1, and fed toward the forward/backward rotation roller 26 (see FIG. 5A).

Next, after a lapse of the set time in the timer 1, the control CPU 65 moves the forward/backward rotation roller 26 (downward) from the standby position to the operating position. For the backward operation, the lifting/lowering motor MR shakes the lifting/lowering arm 27 (St 009). In tandem with the operating position shift of the forward/backward rotation roller 26, the control CPU 65 reduces or releases the pressing force of the guide means (52, 55*a*) exerted on the uppermost sheet Su (St 010). This pressing force release is performed by the shift motor MC or shift solenoid 57.

Figure 5B:
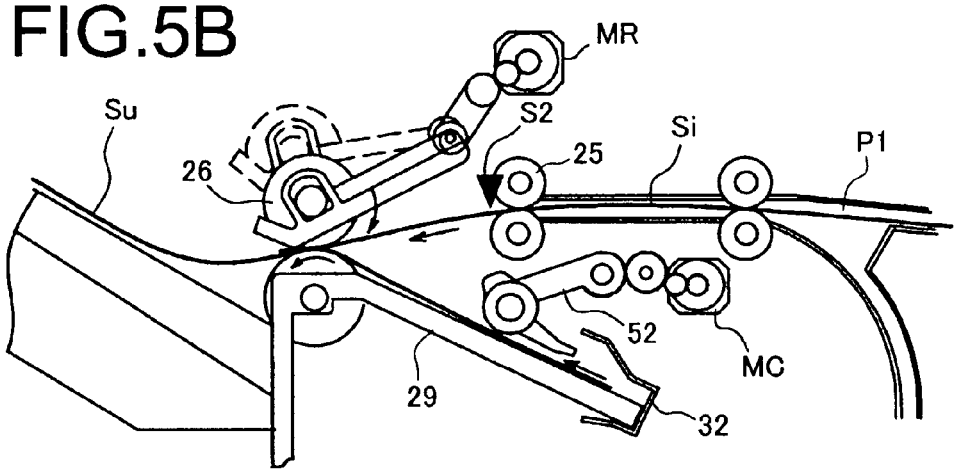
Figure 5C:
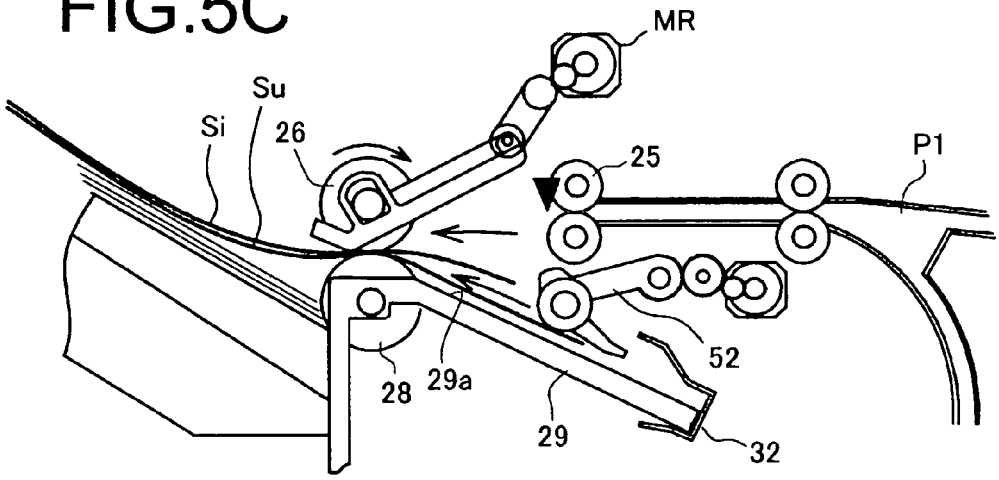

Then, the control CPU 65 rotates the forward/backward rotation roller 26 in the sheet discharge direction (in the clockwise direction in FIG. 2) (St 011). Concurrently with the rotation, the control CPU 65 actuates the timer 2 (St 012). Then, by the rotation of the forward/backward rotation roller 26, the carried-in sheet Si moves forward in the sheet discharge direction as shown in FIG. 5B. When the carried-in sheet Si shifts in the sheet discharge direction by a predetermined distance, the uppermost sheet Su mutually engaged by the press-contact force of the forward/backward rotation roller 26 also moves forward in the sheet discharge direction (see FIG. 5C).

Figure 6A:
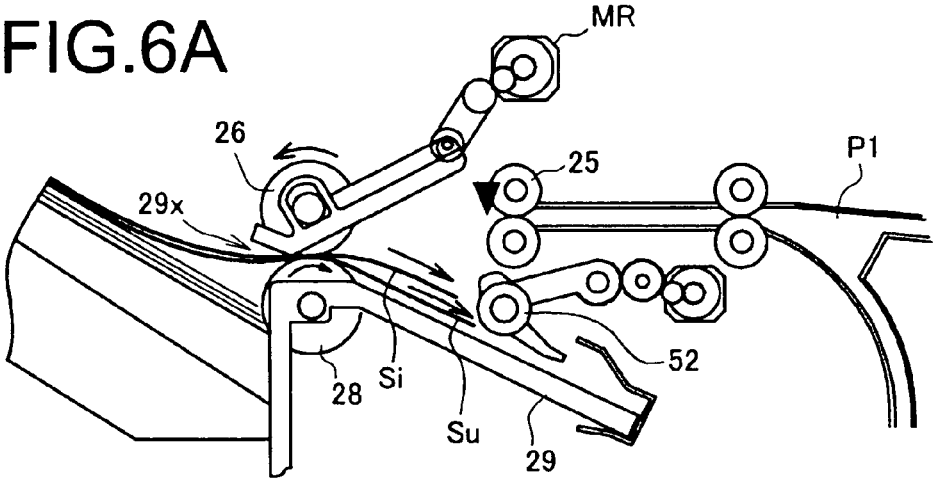
FIG. 6 contains FIGS. 6A to 6C showing operating state explanatory views in the apparatus in FIG. 2.

The timer 2 is set for the predicted time that the sheet rear end is fed from the sheet discharge outlet 25*x* onto the processing tray. After a lapse of the time, the control CPU 65 regards the sheet rear end as being completely carried onto the processing tray, and halts the forward/backward rotation roller 26 (St 013). Concurrently therewith, the control CPU 65 rotates backward the forward/backward rotation roller 26 in the opposite direction to the sheet discharge direction (St 014). Concurrently with the backward rotation of the forward/backward rotation roller 26, the control CPU 65 actuates a timer 3 (St 015). The timer 3 is set for the predicted time that the sheet rear end enters between the guide means (52, 55*a*) and the uppermost sheet Su. This state is shown in FIG. 6A. When the carried-in sheet Si enters between the guide means (52, 55*a*) and the uppermost sheet Su, the uppermost sheet Su shifts toward the rear-end regulation stopper 32 integrally with the carried-in sheet Si to the right side as viewed in FIG. 6A (see FIG. 6A). By this means, the uppermost sheet Su is neither curved above the processing tray nor raised.

Figure 6B:
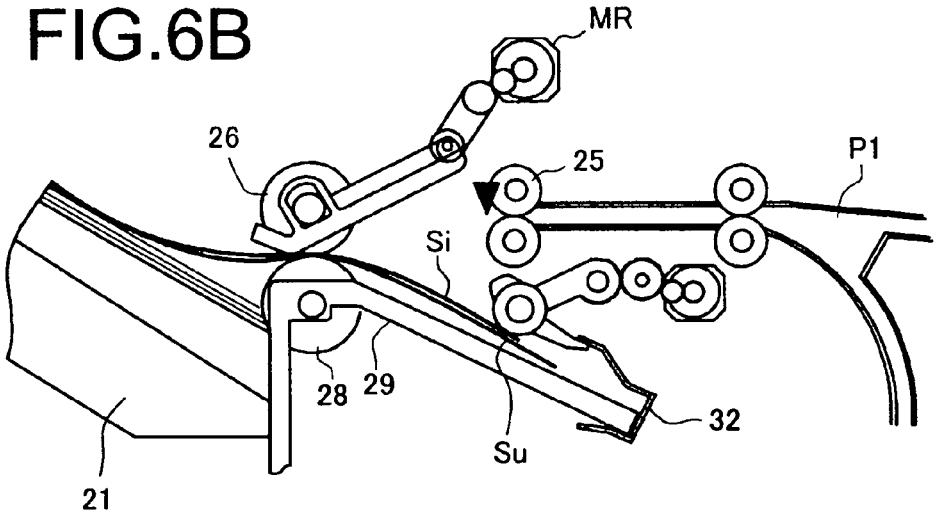
Figure 6C:
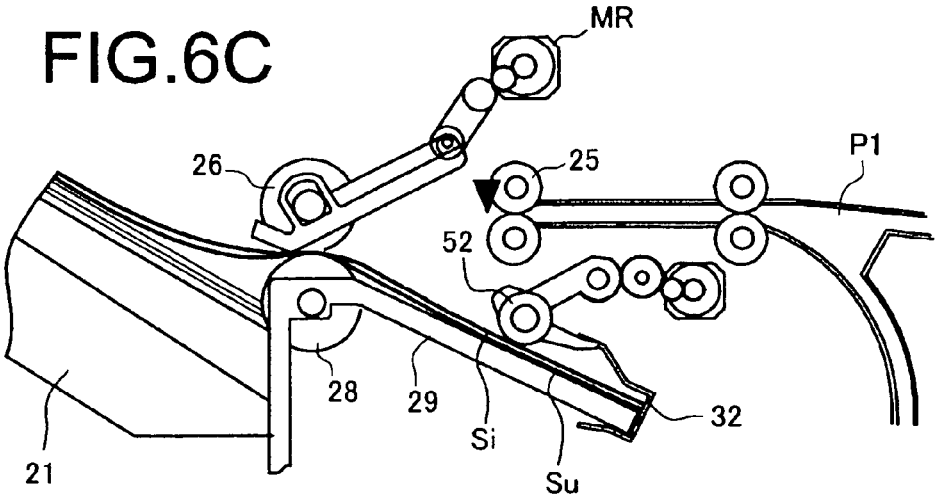

After a lapse of the set time of the timer 3, the control CPU 65 regards the rear end of the carried-in sheet Si as having entered between the guide means (52, 55*a*) and the uppermost sheet Su, and adds the pressing force of the guide means (52, 55*a*) to the predetermined pressure. This addition of the pressing force is performed by the guide shift motor MC or shift solenoid 57. This state is shown in FIG. 6B. FIG. 6B shows the state where the rear end of the carried-in sheet Si enters between the guide means (52, 55*a*) and the uppermost sheet Su, and at this point, since the pressing force of the guide means (52, 55*a*) is released or reduced, the sheet rear end enters with reliability. Further, FIG. 6C shows the state where the pressing force of the guide means (52, 55*a*) is added. In this state, since the carried-in sheet Si and uppermost sheet Su are both pressed by the appropriate pressing force of the guide means (52, 55*a*), both of the sheets are aligned in the accurate attitude without curving or curling in striking the rear-end regulation stopper 32 (see FIG. 6C) (St 017, St 018).

[Second Operation Mode]

When the operation mode setting means sets the second operation mode, among the above-mentioned operations, the control CPU 65 does not execute the operation (St 010) of reducing or releasing the pressing force exerted on the uppermost sheet Su by the guide means (52, 55*a*) concurrently with the operating position shift of the forward/backward rotation roller 26 in the first operation mode, when the front end of the carried-in sheet Si reaches the position to engage in the forward/backward rotation roller 26. In other words, in the second operation mode, the pressing force of the guide means (52, 55*a*) on the uppermost sheet Su on the processing tray is always maintained at constant-value pressing state. Accordingly, the operations of St 010 and St 016 of the first operation mode are not performed in the second operation mode, where in step St 010, the pressing force is reduced or released, and in step St 016, the pressing force is added at the predicted time that the sheer rear end enters between the guide means (52, 55*a*) and uppermost sheet Su. The other operations are the same as in the first operation mode, and descriptions thereof are omitted.

[Sheet Collecting Method]

As is evident from the above-mentioned description, in the sheet collecting method of the invention, the sheet discharge steps (steps St 01 to St 06 as described previously) are executed where a sheet is fed from the sheet discharge outlet 25*x* to the tray means (processing tray) 29. Then, the alignment steps (steps St 014 to St 017 as described previously) are executed where the transport direction of the sheet fed onto the tray means in the aforementioned sheet discharge steps is reversed to cause the sheet rear end to strike the rear-end regulation stopper 32 to align. Then, in the aforementioned sheet discharge steps, the uppermost sheet Su stored on the tray means 29 is fed forward together with the carried-in sheet Si in the sheet discharge direction by a predetermined distance (steps St 010 to St 013 as described previously). Further, in the aforementioned alignment steps, the uppermost sheet Su and carried-in sheet Si are concurrently aligned by striking the rear-end regulation stopper 32 (steps St 014 to St 017 as described previously). By thus aligning the sheets, it is possible to store the carried-in sheet Si in a predetermined position on the processing tray 29 with reliability without suffering interference of the uppermost sheet Su collected on the processing tray.

What is claimed is:

1. A sheet collecting apparatus comprising:

a sheet discharge outlet for carrying out sheets sequentially;

a tray device for bearing and storing sheets from the sheet discharge outlet;

a regulation stopper disposed in the tray device to cause a rear end in a sheet discharge direction of a sheet to strike the stopper to regulate;

a forward/backward rotation roller for feeding the sheet carried onto the tray device from the sheet discharge outlet against the regulation stopper to align;

a roller lifting/lowering device for supporting the forward/backward rotation roller to be able to move up and down between an operating position in which the roller comes into contact with an uppermost sheet and a standby position in which the roller is withdrawn above the sheet with respect to the tray device;

a sheet pressing guide disposed between the forward/backward rotation roller and the regulation stopper to press the uppermost sheet on the tray device;

a pressing force reducing device for reducing or releasing a pressing force of the sheet pressing guide acting on the uppermost sheet; and a control device for controlling the forward/backward rotation roller, the roller lifting/lowering device and the pressing force reducing device, wherein the control device is configured to rotate forward the forward/backward rotation roller in the operating position to move forward a carried-in sheet in the sheet discharge direction by a predetermined distance in carrying the sheet onto the tray device from the sheet discharge outlet, and then rotate backward the forward/backward rotation roller to force the rear end of the carried-in sheet to strike the regulation stopper to align, and the control device has two operation modes that are selectively executed, wherein a first operation mode is configured such that while the control device releases or reduces the pressing force of the sheet pressing guide on the uppermost sheet in rotating forward the forward/backward rotation roller using the pressing force reducing device, thereby moves forward the carried-in sheet and the uppermost sheet in the sheet discharge direction by a predetermined distance, and then, by reverse rotation of the forward/backward rotation roller, concurrently moves backward the carried-in sheet and the uppermost sheet to the regulation stopper, and a second operation mode is configured such that only the carried-in sheet is moved forward in the sheet discharge direction by a predetermined distance with a predetermined pressing force applied to the uppermost sheet on the tray device by the sheet pressing guide in rotating forward the forward/backward rotation roller, and then, the carried-in sheet is moved backward to the regulation stopper by rotating backward the forward/backward rotation roller.

2. The sheet collecting apparatus according to claim 1, wherein the tray device has a sheet mount surface shorter than a length in the sheet discharge direction of a maximum-size sheet configured to be loaded, and the sheet mount surface is provided with a driven roller opposed to the forward/backward rotation roller.

3. The sheet collecting apparatus according to claim 1, wherein the first operation mode and the second operation mode are selected corresponding to a load amount of sheets collected on the tray device and/or sheet properties including a length size, sheet thickness and paper quality of the sheet supplied to the sheet discharge outlet.

4. The sheet collecting apparatus according to claim 1, wherein the sheet pressing guide is formed of a plate-shaped member for pressing the uppermost sheet on the tray device from above, and the pressing force reducing device is formed of operating device for withdrawing the plate-shaped member to above the uppermost sheet.

5. A post-processing apparatus comprising:

a sheet collecting apparatus for bearing and storing sheets from a sheet discharge outlet on a tray device;

a post-processing device disposed in the tray device to perform post-processing including binding processing, folding processing and punching processing on a bunch of collected sheets; and a stack tray for storing the sheets subjected to the post-processing in the tray device, wherein the stack tray is disposed on the downstream side of the tray device so as to support a front end portion of the sheets supported at its rear end portion by the tray device, and the sheet collecting apparatus has a configuration according to claim 1.

6. An image formation system comprising:

an image formation apparatus for forming images on sheets sequentially; and a post-processing apparatus for collecting sheets from the image formation apparatus on a collection tray to perform post-processing, wherein the post-processing apparatus has a configuration according to claim 5.

7. A sheet collecting method for loading and storing sheets in a tray device disposed on a downstream side of a sheet discharge outlet, comprising:

a sheet discharge step of feeding a sheet from the sheet discharge outlet to the tray device; and an aligning step of reversing a transport direction of the sheet fed onto the tray device in the sheet discharge step to force a rear end of the sheet to strike a regulation stopper to align, wherein in the sheet discharge step, an uppermost sheet stored on the tray device is fed forward together with a carried-in sheet in a sheet discharge direction by a predetermined distance, and in the aligning step, the uppermost sheet and the carried-in sheet are concurrently forced to strike the regulation stopper to align, and the sheet discharge step and the aligning step selectively execute a first or second operation mode by a control device;

wherein the first operation mode is configured such that while the control device releases or reduces a pressing force of a sheet pressing guide on the uppermost sheet in rotating forward a forward/backward rotation roller using a pressing force reducing device, thereby moves forward the carried-in sheet and the uppermost sheet in the sheet discharge direction by a predetermined distance, and then, by reverse rotation of the forward/backward rotation roller, concurrently moves backward the carried-in sheet and the uppermost sheet to the regulation stopper, and the second operation mode is configured such that only the carried-in sheet is moved forward in the sheet discharge direction by a predetermined distance with a predetermined pressing force applied to the uppermost sheet on the tray device by the sheet pressing guide in rotating forward the forward/backward rotation roller, and then, the carried-in sheet is moved backward to the regulation stopper by rotating backward the forward/backward rotation roller.

* * * * *